US005233846A

United States Patent [19]

Seta et al.

[11] Patent Number: 5,233,846

[45] Date of Patent: Aug. 10, 1993

[54] NEEDLES FOR KNITTING MACHINES

[75] Inventors: Kazuo Seta, Tanabe; Yuji Kawase, Nishimuro, both of Japan

[73] Assignee: Fukuhara Needle Co., Ltd., Wakayama, Japan

[21] Appl. No.: 898,676

[22] Filed: Jun. 15, 1992

[30] Foreign Application Priority Data

Jun. 25, 1991 [JP] Japan ..... 3-181959

[51] Int. Cl.[5] ..... D04B 35/02

[52] U.S. Cl. ..... 66/123

[58] Field of Search ..... 66/123, 116, 121

[56] References Cited

U.S. PATENT DOCUMENTS

| | | | |
|---|---|---|---|
| 2,010,205 | 8/1935 | Swinglehurst | 66/123 |
| 3,464,237 | 9/1969 | Kohorn . | |
| 3,875,767 | 4/1975 | Kopal et al. | 66/123 |
| 4,068,500 | 1/1978 | Kohorn . | |
| 4,089,192 | 5/1978 | Kohorn . | |
| 4,452,053 | 6/1984 | Egbers et al. . | |
| 4,696,170 | 9/1987 | Tibbals, Jr. | 66/123 X |

FOREIGN PATENT DOCUMENTS

| | | | |
|---|---|---|---|
| 2113603 | 10/1971 | Fed. Rep. of Germany . | |
| 2260262 | 8/1975 | France . | |
| 220351 | 10/1983 | German Democratic Rep. | 66/123 |
| 650996 | 1/1963 | Italy | 66/123 |
| 239065 | 10/1986 | Japan . | |
| 61239065 | 10/1986 | Japan . | |
| 2000529 | 1/1979 | United Kingdom . | |
| 2070075 | 9/1981 | United Kingdom | 66/123 |
| 2173518 | 10/1986 | United Kingdom . | |

OTHER PUBLICATIONS

72-Feeder Interlock Knitting at 36 R.P.M. Knitting International Dec. 1978, vol. 85, No. 1020, pp. 41 & 42.

*Primary Examiner*—Clifford D. Crowder
*Assistant Examiner*—John J. Calvert
*Attorney, Agent, or Firm*—Wegner, Cantor, Mueller & Player

[57] ABSTRACT

Needles for knitting machines are disclosed which are effective in preventing damage to the head and abrasion loss of the butt. In a needle having a bridge, stem and/or guide piece, the width of the bridge, stem and/or the guide piece is wider at the side which is nearer to the butt, than at the side which is farther from the butt. When such a needle has more than one bridge, more than one stem, and/or more than one guide piece, the width of at least one bridge, stem and/or guide piece which is nearer to the butt is wider than that of the bridge, stem and/or guide piece which is farther from the butt.

15 Claims, 2 Drawing Sheets

NEEDLES FOR KNITTING MACHINES

BACKGROUND OF THE INVENTION

The present invention relates to needles for knitting machines, especially for circular knitting machines.

Knitting needles are placed with their backs contacting the needle beds of the needle grooves in a cylinder of a circular knitting machine. The knitting needles rotate at a high speed as the cylinder rotates, and, at the same time, the needle butts perform high-speed reciprocating movement as they are activated by cams in fixed cam holders that are so arranged to face the needle butts.

As the knitting speed becomes faster, the force applied by the cam to the butt becomes larger, which force is transmitted to the needle head in shock waves, causing damage to the needle head. To solve this problem, it is known to be effective to provide cutouts on the needle body that is between the butt and the needle head alternately from the upper side and the lower side, which gives the entire needle a meander-form by forming bridges therein (see, for example, Japanese Patent Laid-Open No. 61-239065). It is also known to be effective to make the width of the meander-form stem as narrow as possible. (In this specification and claims, "width" of a needle part means vertical height of the needle part when placed as in the accompanying drawings.)

However, by making the stem narrow, there sometimes occurred damage to the needle body at a bridge portion near the butt, presumably because of the concentration of stress at such a place, where the needle body suddenly becomes narrow.

SUMMARY OF THE INVENTION

The shock applied by the cam to the butt is considered to be strongest at the butt and becomes weaker in proportion to the distance from the butt, since the shock waves are gradually absorbed during its transmission in the stem. The present invention, which was accomplished based on this theory, provides needles having a special configuration.

In a first aspect, a needle of the present invention comprises a head having a hook and a latch, a neck, at least one butt, a rear portion, at least one bridge between the head and the butt and/or between the rear portion and the butt, said bridge protruding from the level of the neck, the width of said bridge being wider at the side which is nearer to the butt, than at the side which is farther from the butt.

In a second aspect, a needle of the present invention comprises a head having a hook and a latch, a neck, at least one butt, a rear portion, at least two bridges between the head and the butt and/or between the rear portion and the butt, said bridges protruding from the level of the neck, the width of the bridge which is nearer to the butt being wider than that of the bridge which is farther from the butt.

In a third aspect, a needle of the present invention comprises a head having a hook and a latch, a neck, at least one butt, a rear portion, at least one stem between the head and the butt and/or between the rear portion and the butt, said stem being of the same level as the neck, the width of stem being wider at the side which is nearer to the butt, than at the side which is farther from the butt.

In a fourth aspect, a needle of the present invention comprises a head having a hook and a latch, a neck, at least one stem which is of the same level as the neck, at least one bridge which protrudes from the level of the neck, at least one butt, a rear portion, at least two guide pieces which are between the head and the butt and/or between the rear portion and the butt, said guide pieces connecting the stem and the bridge, the width of the guide piece which is nearer to the butt being wider than that of the guide piece which is farther from the butt.

In a fifth aspect, a needle of the present invention comprises a head having a hook and a latch, a neck, at least one butt, a rear portion, at least two stems between the head and the butt and/or between the rear portion and the butt, said stems being of the same level as the neck, the width of the stem which is nearer to the butt being wider than that of the stem which is farther from the butt.

The above-mentioned aspects of the invention can be combined in any combination. Usually, it is advantageous to combine as many aspects as possible in a needle.

Preferably, the width of the neck is 1.1 mm or less and it is wider at the side of the butt than at the side of the head.

According to this invention, since the shock applied by the cam to the butt is gradually and smoothly absorbed by a stem or a bridge near the butt due to their special configurations, the head is less likely to be get damaged. Furthermore, since the shock is alleviated by this invention, the abrasion of the butt is decreased.

BRIEF DESCRIPTION OF THE DRAWINGS

The present invention will now be described in detail in connection with the accompanying drawings, in which.

DESCRIPTION OF THE PREFERRED EMBODIMENTS

Figure 1:
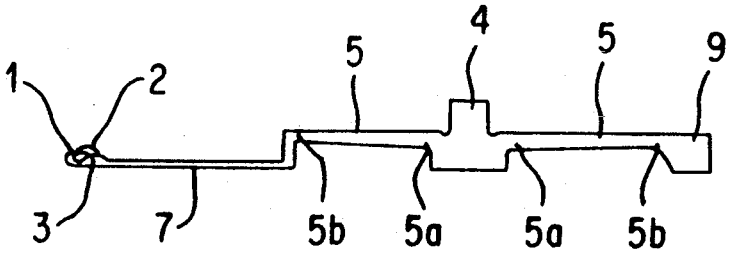
FIG. 1 shows a needle of a first example of the present invention.

Referring first to FIG. 1, which shows a first example of the present invention, the needle has such elementary needle components as head 3 having a hook 1 and a latch 2, a neck 7, at least one butt 4 and a rear portion 9, as is usual in any latch needle. The needle also has a bridge 5 between the head 3 and butt 4 and another bridge 5 between the rear portion 9 and the butt, which bridges are protruded from the level of the neck 7.

The first aspect of the present invention is that the width of the bridge(s) 5 between the head 3 and the butt 4 and/or between the rear portion 9 and the butt 4 is wider at the side 5*a*, which is nearer to the butt 4, than at the side 5*b*, which is farther from the butt 4.

Figure 2:
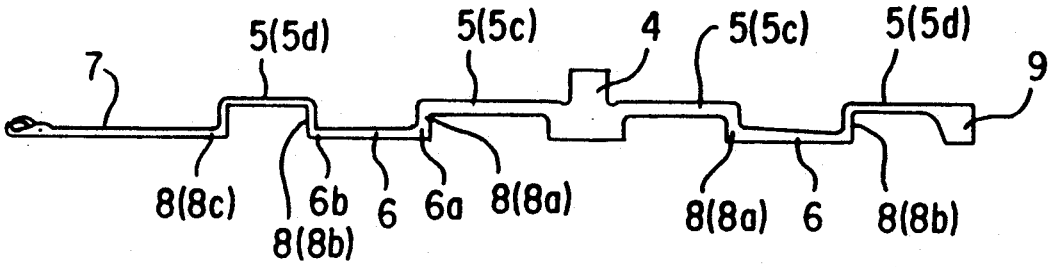
FIG. 2 shows a needle of a second example of the present invention.

Referring next to FIG. 2, which shows a needle of a second example of the present invention, the needle has such elementary needle components as head 3 having a hook 1 and a latch 2, a neck 7, at least one butt 4 and rear portion 9. Also the needle has two bridges 5 (5*c*, 5*d*)

between the head 3 and butt 4 and another two bridges 5 (5c, 5d) between the rear portion 9 and the butt 4, which bridges are protruded from the level of the neck 7.

The second aspect of the present invention is that between the head 3 and the butt 4 and/or between the rear portion 9 and the butt 4, the width of the bridges 5d, which are nearer to the butt 4, is wider than that of the bridges 5c, which are farther from the butt 4.

From another view point, the needle of FIG. 2 has a needle stem 6, which is of the same level as the neck 7, between the head 3 and the butt 4, and another stem between the rear portion 9 and the butt 4. (In this specification and claims, "stem" means a part of the needle body having the same level as the neck 7 and not including the neck.)

The third aspect of the present invention is that the width of the stem(s) 6 between the head 3 and the butt 4 and/or between the rear portion 9 and the butt 4 is wider at the side 6a which is nearer to the butt 4, than at the side 6b, which is farther from the butt 4.

From still another view point, the needle of FIG. 2 has three guide pieces 8 (8a, 8b, 8c) which connect the stem 6 and the bridges 5 between the head 3 and the butt 4, and another two guide pieces (8a, 8b) between the rear portion 9 and the butt 4.

The fourth aspect of the present invention is that between the head 3 and the butt 4 and/or between the rear portion 9 and the butt 4, the width of the guide piece 8c, which is farther from the butt 4, is narrower than that of the guide piece 8a, which is nearer to the butt 4. When there are three guide pieces, the intermediate guide piece 8b has an intermediate width.

As shown in FIG. 2, the above-mentioned aspects of the present invention can be employed in any combination.

Figure 3:
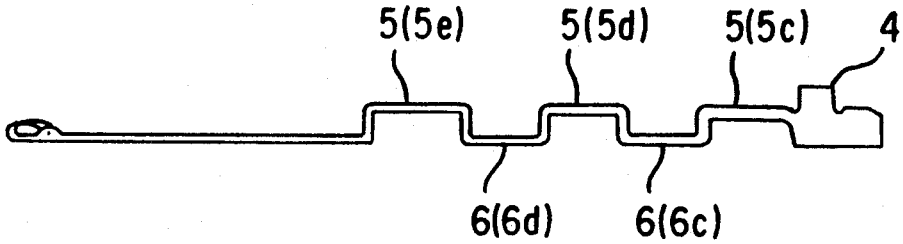
FIG. 3 shows a needle of a third example of the present invention.

Referring next to FIG. 3, which shows a needle of a third example of the present invention, the needle has such elementary needle components as head 3 having a hook 1 and a latch 2, a neck 7, at least one butt 4 and rear portion 9. Also the needle has two stems 6 (6c, 6d) between the head 3 and butt 4, which stems are of the same the level of the neck 7.

Figure 4:
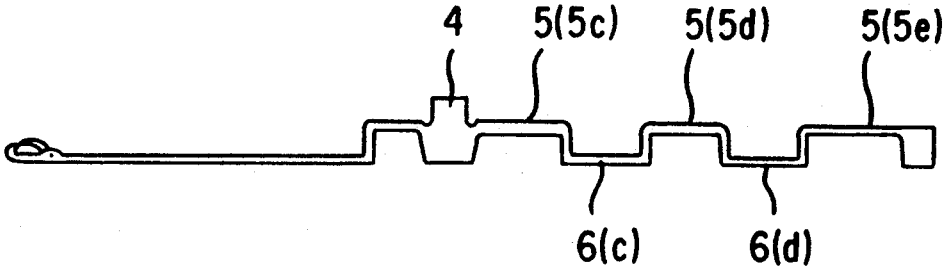
FIG. 4 shows a needle of a fourth example of the present invention.

Referring next to FIG. 4, which shows a needle of a fourth example of the present invention, the needle has such elementary needle components as head 3 having a hook 1 and a latch 2, a neck 7, at least one butt 4 and rear portion 9. Also the needle has two stems 6 (6c, 6d) between the rear portion 9 and the butt 4, which stems are of the same the level of the neck 7.

The fifth aspect of the present invention shown in FIG. 3 and FIG. 4 is that between the head 3 and the butt 4 and/or between the rear portion 9 and the butt 4, the width of the stem 6d, which is farther from the butt 4, is narrower than that of the stem 6c, which is nearer to the butt 4.

In each of the above examples, the width of the neck is preferably 1.1 mm or less and, though not clear from the drawings, it is preferably wider at the side of the butt 4 than at the side of the head 3.

Figure 5A:
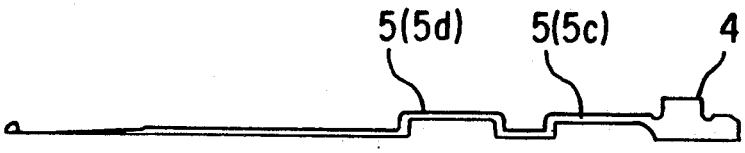
FIG. 5(*a*)(*b*) are needles used in a comparison test between a needle of the present invention (a) and a prior art needle (b).
Figure 5B:
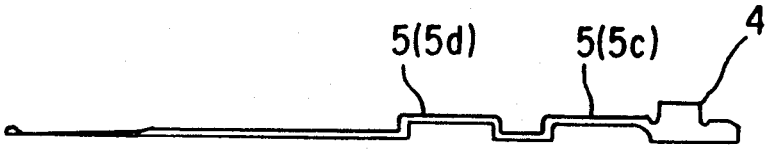

FIGS. 5(a) and (b) show needles used in a comparison test between a needle of the present invention (a) and a prior art needle (b). Using 40 needles of each type in a noload (i.e. without feeding a yarn thereto) rotation experiment, damage to the head and abrasion loss of the butt were determined. The needle of FIG. 4(a) has a weight of 0.502 g. The width of the bridge 5c is 1.2 mm. The width of the bridge 5d is 0.9 mm. The needle of FIG. 4(b) has a weight of 0.514. The width of the two bridges 5c and 5d is 1.2 mm. The results are shown in the following Tables.

DAMAGE TO THE NEEDLE HEAD

| | Number of Rotations | | |
|---|---|---|---|
| | 1 million | 1.56 million | 2 million |
| Present Invention | 0 | 1(H) | 1(C) |
| Prior Art | 0 | 0 | 14(10H + 4C) |

(In the above table, "H" means damage to the hook and "C" means damage to the check of the needle head.)

ABRASION LOSS AFTER 2 MILLION ROTATIONS

| | |
|---|---|
| Present Invention | 0.33 mm |
| Prior Art | 0.37 mm |

It is apparent from the above tables that the present invention is effective in preventing damage to the head and abrasion loss of the butt.

We claim:

1. A needle for knitting machines comprising a head having a hook and a latch, a neck defining a level of the neck, at least one butt, a rear portion, at least one bridge between the head and the butt or between the rear portion and the butt, said bridge protruding from the level of the neck, and defining a length, the width of said bridge being wider at a side which is nearer to the butt, than at a side which is farther from the butt, wherein the width of said bridge reduces gradually over substantially the entire length thereof.

2. A needle for knitting machines as claimed in claim 1, comprising at least one bridge between the rear portion and the butt, said bridge protruding from the level of the neck.

3. A needle for knitting machines as claimed in claim 1, comprising at least one bridge between the head and the butt, said bridge protruding from the level of the neck.

4. A needle for knitting machines comprising a head having a hook and a latch, a neck defining a level of the neck, at least one butt, a rear portion, at least two bridges between the head and the butt or between the rear portion and the butt, each of said bridges protruding from the level of the neck, and defining a length, the width of the bridge which is nearer to the butt being wider than that of the bridge which is farther from the butt, wherein the width of at least one of said at least two bridges reduces gradually over substantially the entire length thereof.

5. A needle for knitting machines as claimed in claim 4, comprising at least two bridges between the rear portion and the butt, said bridges protruding from the level of the neck.

6. A needle for knitting machines as claimed in claim 4, comprising at least two bridges between the head and the butt, said bridges protruding from the level of the neck.

7. A needle for knitting machines comprising a head having a hook and a latch, a neck defining a level of the neck, at least one butt, a rear portion, at least one stem, between the head and the butt or between the rear portion and the butt, at the same level as the level of the neck, and defining a length, the width of the stem being wider at a side which is nearer to the butt, than at a side which is farther from the butt, wherein the width of said stem reduces gradually over substantially the entire length thereof.

8. A needle for knitting machines as claimed in claim 7, comprising at least one stem between the rear portion and the butt at the same level as the level of the neck.

9. A needle for knitting machines as claimed in claim 7, comprising at least one stem between the head and the butt, said stem being at the same level as the level of the neck.

10. A needle for knitting machines comprising a head having a hook and a latch, a neck defining a level of the neck, at least one butt, a rear portion, at least two stems between the head and the butt or between the rear portion and the butt, at the same level as the level of the neck, each of said stems defining a length, the width of the stem which is nearer to the butt being wider than that of the stem which is farther from the butt, wherein the width of at least one of said at least two stems reduces gradually over substantially the entire length thereof.

11. A needle for knitting machines as claimed in claim 10, comprising at least two stems between the rear portion and the butt, said stems being at the same level as the level of the neck.

12. A needle for knitting machines as claimed in claim 10, comprising at least two stems between the head and the butt, said stems being at the same level as the level of the neck.

13. A needle for knitting machines comprising a head having a hook and a latch, a neck defining a level of the neck, at least one stem at the same level as the level of the neck, at least one bridge which protrudes from the level of the neck, at least one butt, a rear portion, at least two guide pieces which are between the head and the butt, said guide pieces connecting the stem and the bridge, the width of the guide piece which is nearer to the butt being wider than that of the guide piece which is farther from the butt.

14. A needle for knitting machines as claimed in claim 13, comprising at least two guide pieces which are between the rear portion and the butt, said guide pieces connecting the stem and the bridge.

15. A needle for knitting machines as claimed in claim 13, comprising at least two guide pieces between the head and the butt, said guide pieces connecting the stem and the bridge.

* * * * *